United States Patent [19]

Dahlgren et al.

[11] 4,373,442

[45] Feb. 15, 1983

[54] PORTABLE INK FOUNTAIN

[76] Inventors: Harold P. Dahlgren, 4008 Buena Vista, Dallas, Tex. 75205; William A. Sullivan, 3821 Grand Teton Crt., Irving, Tex. 75062; John W. Gardiner, 3028 White Oak La., Bedford, Tex. 76021; James E. Taylor, 4129 Drowsy La., Dallas, Tex. 75233

[21] Appl. No.: 203,662

[22] Filed: Nov. 3, 1980

[30] Foreign Application Priority Data

Nov. 5, 1979 [WO] PCT Int'l Appl. ..... PCT/US79/00947

[51] Int. Cl.[3] ..... B41F 31/06; B41F 31/12; B41F 31/32; B41F 7/26

[52] U.S. Cl. ..... 101/207; 101/148; 101/209; 101/351; 101/352

[58] Field of Search ..... 101/349, 350, 351, 352, 101/363, 426, 364, 148, 138, 207, 208, 209, 210

[56] References Cited

U.S. PATENT DOCUMENTS

| | | | |
|---|---|---|---|
| 2,333,962 | 11/1943 | Terry | 101/351 |
| 3,552,311 | 1/1971 | Petri | 101/350 X |
| 3,746,957 | 7/1973 | Forster et al. | 101/248 X |
| 3,791,294 | 2/1974 | Skelding et al. | 101/352 X |
| 3,901,150 | 8/1975 | Kirby, Jr. | 101/351 |
| 3,986,452 | 10/1976 | Dahlgren | 101/148 |
| 4,233,898 | 11/1980 | Dahlgren | 101/148 X |

*Primary Examiner*—J. Reed Fisher

[57] ABSTRACT

An object of the invention is to provide a method of metering to a printing plate (P). An applicator roller (312), which receives ink from a pick-up roller (310), is positioned in pressure indented relation with a metering roller (12). The surface speed of metering roller (12) is varied to meter the ink to roller apparatus which supplies the ink to printing plate (P).

4 Claims, 11 Drawing Figures

PORTABLE INK FOUNTAIN

BACKGROUND OF THE INVENTION

Newspaper printing presses are generally constructed to provide either two or four printing plates spaced across the plate cylinder so that each plate on the plate cylinder contacts a web of newsprint simultaneously. Each of the printing plates on the plate cylinder will usually apply the same color ink. However, it is sometimes desirable or necessary for applying ink of a different color to one of the printing plates or to apply no ink at all to a portion of the web.

Portable color fountains have been employed heretofore for providing spot color to one of a plurality of printing plates on a plate cylinder.

The invention disclosed herein relates to improvements in portable ink fountains which are particularly adapted for use in combinations with an inker of the type disclosed in co-pending U.S. application Ser. No. 797,262, filed Apr. 18, 1978.

SUMMARY OF THE INVENTION

The improved portable ink fountain construction comprises a pick-up roller and an applicator roller one having a hard surface and the other having a resilient surface urged into pressure indented relationship. The pick-up roller is adapted to meter an excess of ink at a flooded metering nip between the pick-up roller and the applicator roller such that a controlled thickness of ink is metered onto the surface of the applicator roller. The film of ink on the applicator roller is transferred at a supply nip between the applicator roller and a metering roller. The speed differential between the metering roller and a transfer roller permits slippage for forming a thin, smooth layer of ink on the transfer roller as the ink is sheared and metered. The transfer roller then applies the ink to a form roller.

The transfer roller and the form roller are driven at approximately the surface speed of the printing plate which engages the form roller.

If the printing plate is hard, the form roller should have a resilient surface. To reduce power required for slipping rollers at a transfer nip located between the metering and transfer rollers, the transfer roller is provided with a hard surface and is driven at a greater surface speed than a resilient covered metering roller against which it slips, as described in application for letters patent entitled "INKER FOR NEWSPAPER PRESS", International Application No. PCT/US79/00948, filed Nov. 4, 1979 and corresponding U.S. application Ser. No. 203,607, filed Nov. 3, 1980.

In a preferred embodiment of our invention, the portable ink fountain comprises a pan to hold a quantity of ink. An applicator roller is rotatably connected to the pan to provide an output of ink in a controlled quantity. A pick-up roller is provided in the pan to supply ink to the applicator roller. Apparatus rotatably connects the pick-up roller to the pan for adjustably positioning the pick-up roller relative to the applicator roller to effect the controlled quantity of ink output.

Further, the preferred portable ink fountain of our invention may comprise a pan to hold a quantity of ink. An applicator roller is rotatably connected to the pan to provide an output of ink. A pick-up roller is rotatably disposed in the pan to supply ink to the applicator roller. Apparatus is connectable to the pan to adjustably position the pan relative to a printing cylinder on a printing press.

A primary object of the invention is to provide a portable ink fountain that is adjustably mounted relative to a printing cylinder for application of ink to a selected printing plates on the cylinder.

Another object of the invention is to provide a portable ink fountain that is adjustably mounted relative to a printing cylinder for selectively withholding an ink supply from portions of that cylinder.

Another object of the invention is to provide a portable ink fountain that regulates the ink output by controlling the pressure indented relation between a pick-up roller and an applicator roller supported by a pan.

Another object of the invention is to provide a portable ink fountain that regulates the ink output with such regulating apparatus being controlled at a location remote from the portable ink fountain.

Another object of the invention is to provide a portable ink fountain that uses a pan to hold a quantity of ink which may be disconnected from the ink press for cleaning without the necessity to readjust the applicator roller relative to a metering roller in the inker for the press.

Another object of the invention is to provide an inker wherein the ink film thickness if controlled by varying the surface speed of a form roller relative to the surface speed of an adjacent roller.

Another object of the invention is to provide a portable ink fountain used with an inker which is equipped with rollers having relatively small diameters to provide substantial indentation and pressure at a transfer nip while minimizing the stripe width and shear area between a metering roller and a transfer roller.

Another object is to minimize the power required to slip one roller against another roller at an ink transfer nip by maintaining an ink film thickness adjacent the transfer nip to assure lubrication.

A further object is to provide a hard surfaced roller and a resilient surfaced roller in pressure indented relation to meter ink wherein the resilient surface moves slower than the hard surface to minimize deformation of the resilient surface at the nip.

A still further object of the invention is to provide a hard surfaced idler roller between a pair of resilient rollers, the resilient rollers having different surface speeds, to control the thickness of an ink film applied to one of the resilient rollers.

Other and further objects will become apparent upon referring to the following detailed description and the attached drawings.

DR

BRIEF DESCRIPTION OF THE DRAWINGS

Drawings of a preferred embodiment of the invention are annexed hereto so that the invention may be better and more fully understood, in which.

Numeral references are employed to designate like parts throughout the various figures of the drawings.

DESCRIPTION OF A PREFERRED EMBODIMENT

Figure 1:
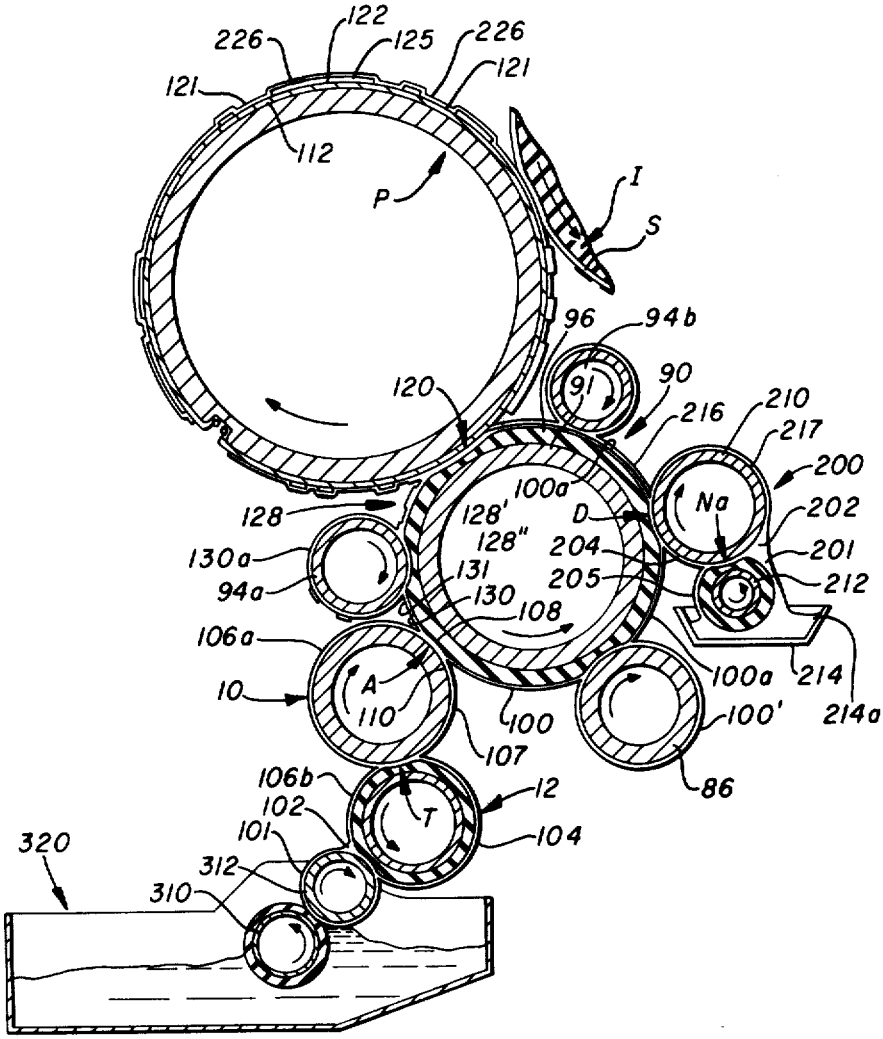
FIG. 1 is a diagrammatic illustration of the inking system for a lithographic printing press illustrating the various films of ink and dampening fluid.

In FIG. 1 of the drawing, the numeral 1 generally designates an ink applicator apparatus for applying ink and dampening fluid to a lithographic printing plate of a printing press. The water applicator 200 is a dampener of the type disclosed in U.S. Pat. No. 3,937,141, entitled "DAMPENER FOR LITHOGRAPHIC PRINTING PLATES" which issued Feb. 10, 1976 to Harold P. Dahlgren. The disclosure of U.S. Pat. No. 3,937,141 is incorporated herein by reference in its entirety for all purposes.

Figure 2:
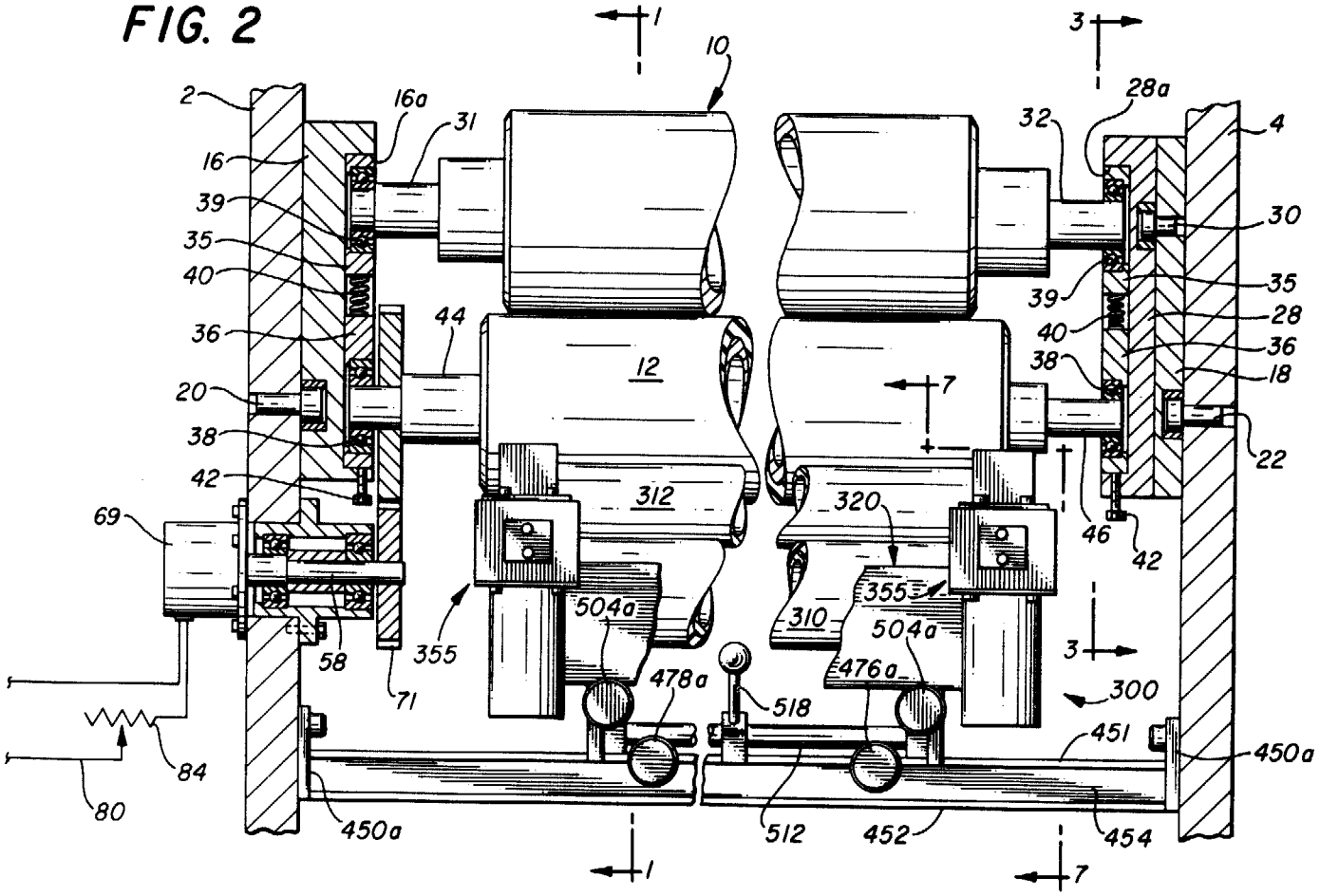
FIG. 2 is a front elevational view illustrating the metering, transfer, and applicator rollers and support structure.

As best illustrated in FIG. 2, ink applicator 1 comprises spaced side frames 2 and 4 joined by tie bars (not shown) forming a strong rigid structure for supporting form roller 90, ink transfer roller 10, ink metering roller 12, ink applicator roller 312, and ink pick-up roller 310. Side frames 2 and 4 may be the side frames of a press or may comprise inker side frames connectable to side frames of a printing press.

Throw-off links 16 and 18 are pivotally secured by stub shafts 20 and 22 to the respective side frames 2 and 4. Throw-off cylinders 24 and 26 are pivotally connected between side frames 2 and 4 and throw-off links 16 and 18, respectively, for pivoting throw-off links 16 and 18 about stub shafts 20 and 22 for moving metering roller 12 into position, as will be hereinafter more fully explained, for delivering ink over a transfer roller 10 to a form roller 90 in a lithographic printing system.

A skew arm 28 may be mounted or pivotal movement of one end of metering roller 12 about the axis of ink transfer roller 10. As diagrammatically illustrated in FIG. 2, skew arm 28 is rotatably secured to stub shaft 30 extending between link 18 and skew arm 28 adjacent an end of ink transfer oller 12.

Skew arm 28 and throw-off link 16 have grooves 28*a* and 16*a*, respectively, formed in the inner surfaces thereof in which blocks 36, carrying self-aligning bearings 38, are slidably disposed. Blocks 35 are rigidly secured in the upper portion of grooves 28*a* and 16*a* by screws 37 to provide suitable support for shafts 31 and 32 of the ink transfer roller 10. Suitable means such as resilient springs 40 between blocks 35 and 36 urge blocks 36 longitudinally of skew arm 28 and throw-off link 16 in a direction away from the longitudinal axis of transfer roller 10. A pressure adjustment screw 42 urges block 36 longitudinally of skew arm 28 and throw-off link 16 against the bias of springs 40. Stub shafts 44 and 46, extending outwardly from opposite ends of metering roller 12, are received in self-aligning bearings 38 to rotatably secure transfer roller 10 in pressure indented relation with metering roller 12. Stub shafts 31 and 32, extending outwardly from opposite ends of transfer roller 10, are received in bearings 39 in blocks 35.

It should be readily apparent that rotation of pressure adjustment screws 42 will move opposite ends of metering roller 12 relative to the axis of transfer roller 10 for controlling pressure between transfer roller 10 and metering roller 12.

Figure 3:
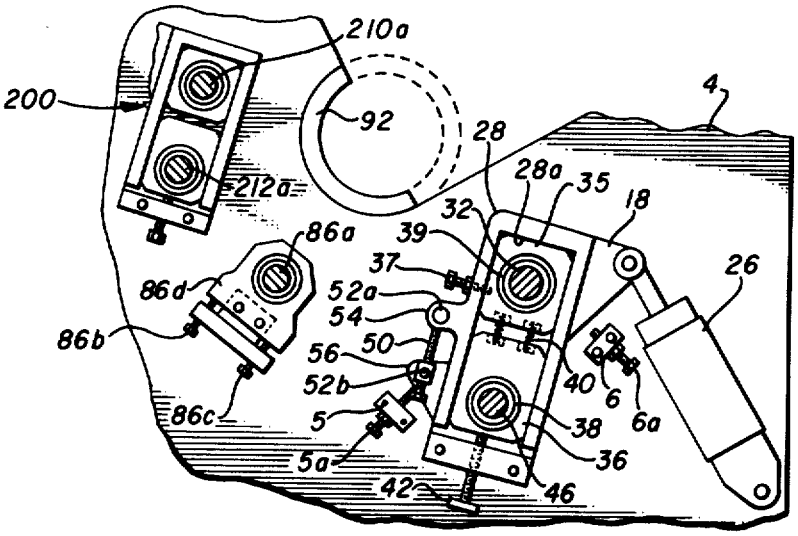
FIG. 3 is a cross-sectional view taken along line 3—3 of FIG. 2.

As illustrated in FIG. 3, suitable means is provided for establishing and maintaining a desired angular relationship between throw-off link 18 and skew arm 28. In the form of the invention illustrated in FIG. 3, an adjusting screw 50 is rotatably secured to skew arm 28 and extends through threaded apertures in pivotal blocks 52*a* and 52*b*. Blocks 52*a* and 52*b* are pivotally secured to lug 54 on arm 28 and lug 56 on link 18. By adjusting screw 50, the spacing between lugs 54 and 56 is adjusted to move skew arm 28 relative to link 18 about shaft 30.

Side frames 2 and 4 have suitable adjustable stop means such as stop blocks 5 having set screws 5*a* extending therethrough for engaging throw-off links 16 and 18 when rods of throw-off cylinders 24 and 26 are extended for establishing a desired pressure relationship between the metering cylinder 12 and an ink coated transfer roller 10 arranged to transfer ink over a form roller 90 in a lithographic or relief printing plate 112 on plate cylinder P, as will be hereinafter more fully explained. Stop means such as stop blocks 6, having set screws 6*a* secured thereto, provide an "off-impression" limit when piston rods of throw-off cylinders 24 and 26 are retracted to move the metering roller 12 away from the surface of transfer roller 10.

Stub-shaft 44, extending outwardly from the end of metering roller 12, has a gear 60, rigidly secured thereto by a key, which is in meshing relation with a gear 71 secured on a shaft 58 which is rotatably secured through an opening in side frame 2. Shaft 58 is secured to the shaft of a reversible variable speed drive means such as a reversible variable speed electric gear-motor 69. It should be appreciated that gear-motor 69 may be replaced by other drive means such as gears, sprockets, or pulleys arranged to be driven from the printing press drive, preferably through a gear box or similar variable speed control apparatus.

Power supply line 80 is connected through a variable rheostat 84 to the terminals of motor 69 so that motor may be run at variable speeds to control the speed of rotation, and, consequently, the surface speed of metering roller 12 independently of the press drive which controls the speed of roller apparatus or means that supply ink to plate P, in this instance rollers 10 and 90. If it is deemed expedient to do so motor 69 could be replaced by a speed-variable coupling which connects shaft 58 to the press drive means, as hereinbefore described.

Suitable means is provided for delivering an abundant supply of ink to the ink metering nip N between adjacent surfaces of applicator roller 312 and pick-up roller 310. In the particular embodiment of the invention illustrated in FIG. 1, a portion of the surface of pick-up roller 310 is submerged in ink 14*a* in ink pan 320.

Ink 14a preferably is of the type employed for inking raised image areas in letter press printing or the type used in direct or offset lithographic printing or newsprint or similar materials.

Pick-up roller 310 and metering roller 12 preferably comprise a hollow tubular sleeve with a resilient cover 12c secured about the outer surface of the sleeve. The material is selected so as to be oleophillic and the surface may be smooth or textured.

The applicator roller 312 is preferably hard and has an exterior surface which is textured and is ink receptive or oleophillic. Applicator roller 312 may, therefore, have an exterior surface of materials such as copper, steel or plastic. The surface of applicator roller 312 may be either hard or resilient.

Form roller 90 is preferably cut to be the same length as the printing plate to eliminate accumulation of escess ink which will tend to build on the form roll if longer than the printing plate.

Transfer roller 10 has a hard smooth surface similar to that on applicator roller 312.

Referring to FIG. 1 of the drawing, metering roller 12 is preferably positioned in pressure indented relation with transfer roller 10. Transfer roller 10 preferably has a metal tubular core to the ends of which are secured stub shafts extending outwardly therefrom and rotatably journaled in bearings 39 carried by the side frames 2 and 4 which include means to urge applicator roller 10 into pressure indented relation with form roller 90.

Form roller 90 is preferably driven by a gear 90a in meshing relation with a gear 90b driven with the plate cylinder P of the press and has a smooth resilient outer cover.

An ink storage roller 94a, preferably a vibrator roller, is adapted to remove ink from areas 128" from ink film 128 on the surface of form roller 90 and add the ink to the depleted areas 128' thereby creating a more uniform film of ink on the surface of roller 90 moving from the nip 120 toward nip A.

A second ink storage roller 94b, similar to roller 94a, is positioned between plate cylinder P and dampener 200 to smooth the ink film upon reversal of form roller 90 as will be more fully explained hereinafter.

A material conditioning roller 86, preferably a vibrator roller, is rotatably supported on shaft 86a in blocks 86d and is adapted to condition and smooth the surface of ink film 100 to make the film more receptive to accepting dampening fluid. Screws 86b and 86c are adapted to urge blocks 86d and roller 86 into pressure indented relation with form roller 90. The surface of material conditioning roller 86 is preferably of similar material to that of form roller 90 such that the surface has the same affinity for ink as does the surface of form roller 90.

As the ink film 100 emerges from the nip A between form roller 90 and transfer roller 10, it is slick, and calendared. A slick film of ink is not particularly receptive to dampening fluid since the surface tension of the molecules of ink may reject the thin layer dampening fluid to be applied by dampener 200. Material conditioning roller 86 will receive a portion of the film 100 of ink thus splitting the film 100 of ink and producing of film 100' on roller 86 thus leaving film 100a with a matte finish having microscopic indentations. The matte finish on film 100a will more readily accept the thin layer of dampening fluid due to molecular attraction which is now greater than the surface tension of the dampening fluid forming a film 216.

Material conditioning roller 86 and ink storage rollers 94a and 94b are preferably constructed of diameters such that as they rotate, ink will be properly applied or extracted and redistributed on the surface of form roller 90.

Vibrator rollers 86, 94a and 94b are preferably provided with drive means (not shown) to oscillate the rollers in a longitudinal direction. Suitable oscillator drive means is well known to persons skilled in the printing art and further description is not deemed necessary. Rotation is provided through friction contact with adjacent surfaces.

Dampener 200 is diagrammatically illustrated in FIG. 1 and comprises a hydrophillic transfer roller 210 on shaft 210a and a resilient metering roller 212 on shaft 212a, mounted in a similar manner to inker 1, as described in U.S. Pat. No. 3,937,141. Metering roller 212 meters dampening fluid 214a from pan 214 onto transfer roller 210 through flooded nip Na. Water film controlled by pressure between rollers 210 and 212 forms a thin layer of dampening fluid 204 which is metered through dampening fluid transfer nip 106a onto the matte finish of ink film 100a on the surface of form roller 90.

Figure 6:
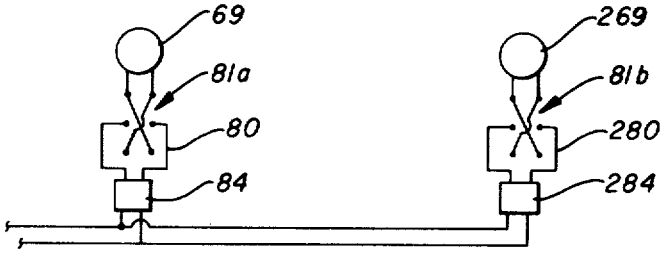
FIG. 6 is a diagrammatic view of the electrical hookup of the motors of dampening and inking units.

Dampener metering roller 212 is driven by a variable speed reversible motor 269. As illustrated in FIG. 6, rheostats 84 and 284 are connected to a suitable electrical supply and are connected to a pair of ganged double pole, double throw switches 81a and 81b to control the direction of motors 69 and 269.

The operation and function of the apparatus hereinbefore described is as follows:

Pressure between the ends of transfer roller 10 and metering roller 12 is adjusted by rotating pressure adjustment screws 42.

Since long rollers urged together in pressure relation tend to deflect or bend, pressure adjacent centers of such rollers is less than pressure adjacent ends thereof. Pressure longitudinally of rollers 10 and 12 is adjusted by rotating screw 50 and rotating skew arm 28 about the axis of transfer roller 10 to a position wherein a desired pressure distribution longitudinally of rollers 10 and 12 is obtained.

Adjustment screw 5a is positioned to engage throw-off links 16 and 18 for establishing a desired pressure between transfer roller 10 and metering roller 12.

For the purpose of graphically illustrating the novel function and results of the process of the mechanism hereinbefore illustrated and described, a diagrammic view of the pick-up roller 310, applicator roller 312, the metering roller 12, transfer roller 10 and the form roller 90 is shown in FIG. 1. Ink and water films shown are exaggerated for clarity.

As shown in FIG. 1, applicator roller 312 from ink fountain 300, when employed to deliver ink to a printing plate 112, is preferably a hard surfaced roller having a surface thereon and receiving ink from pick-up roller 310 immersed in ink 14a in pan 320. The applicator roller 312 is rotatably mounted in pressure indented relation with metering roller 12 as explained hereinafter.

As the surface of roller 310 rotates toward the ink metering nip N between rollers 310 and 312, a relatively heavy layer 101 of ink is picked up and lifted on the surface of roller 310. At the point of tangency, or cusp area at the ink metering nip N, a bead of ink is piled up forming an excess of ink. The greatness of the excess of the ink forming bead is regulated by virtue of the fact that excess ink will fall back into the pan. The bead of ink becomes a reservoir from which ink is drawn by applicator roller 312. As rollers 310 and 312 rotate in pressure indented relation, a layer of ink is metered between adjacent surfaces of the two rollers separated by a thin lubricating layer of ink. Since applicator roller 312 has an oleophillic surface of roller 310 to form a film with the remaining portion of the ink on the surface of roller 310 being rotated back or fed back to the pan 320. The film of ink 101 is then distributed on the surface of roller 12 by reason of the rotating, squeezing action between rollers 12 and 312 at their tangent point. Roller means then carries the film of ink from roller 12 to plate cylinder P.

At nip T, it will be observed that transfer roller 10 is impressed into the resilient surface of the metering roller 12 and that the film of ink 104 on transfer roller 12 contacts ink film 107 on transfer roller 10. The outer surface of film 104 and the outer surface of the film of ink 107 on transfer roller 10 are urged together to create a hydraulic connection between roller 10 and roller 12 as they rotate in close relationship, but there is no physical contact between the roller surfaces.

It is an important fact to note that the relative thick film of ink 104 permits rollers 10 and 12 to be rotated at different surface speeds as will be hereinafter explained.

Preferably, the transfer roller 10 is driven by form roller 90 which is rotated by gear **90*a* at the same surface speed as the printing plate 112, and is rotated at a greater surface speed than the speed of roller 12. By regulating the differential surface speed between metering roller 12 and transfer roller 10, the amount of ink transferred to the transfer roller 10 and applied to form roller 90** may be regulated.

Within limits, as will be hereinafter more fully explained, if the surface speed of metering roller 12 is increased, the ink film 104 is presented at the ink transfer nip T at a faster rate then more ink is transferred to the surface of transfer roller 10, form roller 90 and to lithographic plate 112, and the opposite is true, if the surface speed of roller 10 is decreased.

The film of ink between adjacent surfaces of rollers 10 and 12 permits rollers 10 and 12 to be rotated at different surface speeds in sliding relationship, because the film of ink 104 actually provides lubrication which permits slippage between adjacent surfaces of rollers 10 and 12 without frictional deterioration. By reason of the slippage between rollers 10 and 12, the ink film **106*a* is metered and distributed by shearing the ink between adjacent surfaces of roller 10 and roller 12 to create ink film 106*a*. The thickness of ink film 106*a* is controlled by the pressure between metering roller 14 and transfer roller 12 and the speed of transfer roller 12**.

If it is assumed that a film of ink one unit thick is applied to image areas on the printing plate, the film 216 on form roller 90 will probably be about two units thick, half being transferred to the plate 112 and half being retained as film 128' on the form roller 90. If film 100 is equal to film 216, film **106*a* would be three units thick because film 100 and film 107 are of approximately equal thickness since film 128' is combined with film 106*a* at nip A. Film 104, assuming no slippage, would be four units thick and film 106*b* would be three units thick. Therefore, it should be apparent that 33% of the ink is removed from transfer roller 10 at nip A while only 25% is removed from metering roller 12** at nip T and more ink is available at nip T to provide lubrication than at nip A. Less power is required to slip between roller surfaces at nip T than is required at nip A.

Metering roller 12 preferably is driven at a surface speed which is within a range of for example, several hundred feet per minute slower than the surface speed of transfer roller 10 and form roller 90. For example, if a printing press has paper traveling therethrough at a surface speed of 1200 feet per minute, the surfaces of printing plate 112, form roller 90, and transfer roller 10 will ordinarily have surface speeds of 1200 feet per minute. The transfer roller 10 would preferably rotate at a surface speed less than 240 feet per minute.

Ink films **106*a* and 130 will be combined at ink application nip A and will split when sheared as rollers 10 and 90 rotate away from ink application nip A. The fresh film 100 of ink adheres to the surface of form roller 90. Ink rejected by form roller 90 forms a feedback film 107 of ink which may be slightly irregular which adheres to the surface of applicator roller 10** and is conveyed back to the nip T to be re-metered.

Material conditioning roller 86 splits film 100, taking on a film 100' to produce a matte finish on ink film **100*a*. Any irregularities or streaks in film 100 will be spread and equalized to form film 100*a*** of very uniform thickness.

The interface tension between the outer surface of the less viscous dampening fluid film 204, by reason of molecular attraction between the surface of the more viscous ink film **100*a*, causes a portion 216 of the smooth and regulated film 204 of dampening fluid to be added to the surface of ink film 100*a*, which in turn is transferred to the plate at the tangent point between the plate 112 and form roller 90 at inking nip 120**.

The lithographic printing plate 112 has hydrophillic, or water liking, non-image areas 121 and oleophillic, or ink receptive, image areas 122 formed on the surface thereof. If printing plate 112 is provided with raised image areas, the dampener 200 would not be required to prevent transfer of ink to non-image areas.

At the nip 120 between form roller 90 and printing plate 112, the ink film 100 or 216 is split, forming thin films 125 of ink and water over oleophillic surfaces 122 on the printing plate. The layer 216 of dampening fluid, if dampening fluid is employed, is carried on and in the film 100 of ink and is also distributed to form a thin film 216 of dampening fluid over hydrophillic areas 121 of the printing plate.

No appreciable amount of dampening fluid remains on the surface of form roller 90 which is moving away from the nip 120, but such dampening fluid as does remain thereon is transferred with the ink film 128 to the ink film **130*a* on the ink storage roller 94*a*** where the dampening fluid can be dissipated and/or evaporated to such an extent as to be of no consequence in the inking system.

Ink of film 128 remaining on form roller 90 is combined with film **130*a* on ink storage roller 94*a* and split and collected on roller 94*a*. In on roller 94*a* is added to depleted areas 128' in film 128 thus reducing the effect of ghosting and areas in film 128 by forming a more uniform film 130** before re-entering nip A.

The layer of dampening fluid 216 is applied in substantially the same manner. An excess of dampening fluid 201 is supplied to bead 202 to form a film 204 of dampening fluid which is applied to ink film **100*a* on form roller 90 at nip 106*a*. The film 217 of dampening fluid is returned to bead 202** to be re-metered at nip Na.

From the foregoing it should be readily apparent that the improved apparatus for applying ink to printing systems offers control of metering at ink metering nip N to provide a film of ink of precisely controlled thickness by adjusting pressure between pick-up roller 310 and applicator roller 312 and further by controlling surface speeds of rollers 12 and 14 relative to each other. The rate at which the metered film 104 of ink is offered to film 107 of ink on transfer roller 10 at ink transfer nip T and also the hydraulic force for obtaining the desired film thickness is controlled.

Figure 4:
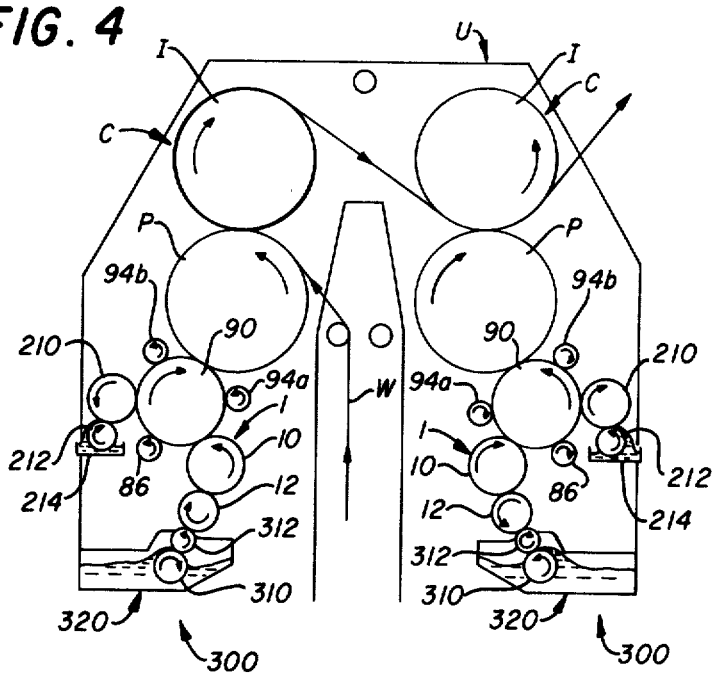
FIG. 4 is a diagrammatic view of a standard printing unit.
Figure 5:
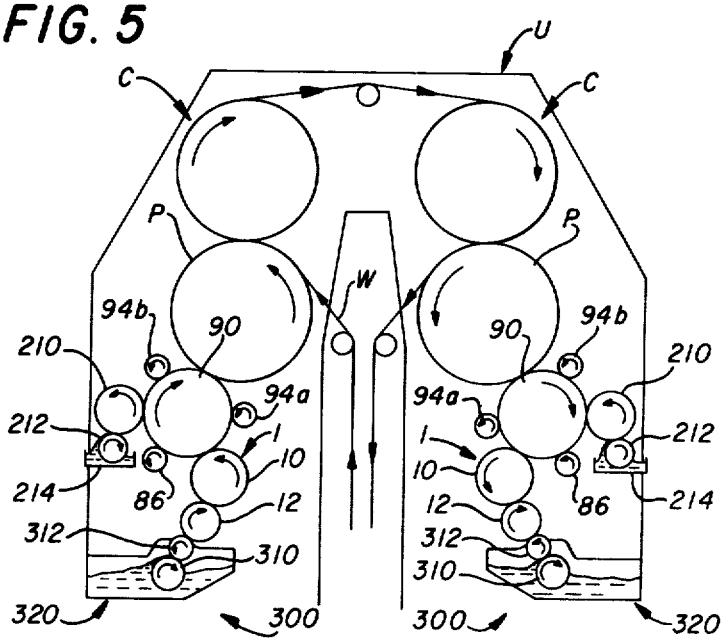
FIG. 5 is a diagrammatic view of a reversed printing unit.

FIG. 4 illustrates a pair of inkers 1 used in the standard configuration to print on both sides of a web W. A printing unit U generally has a pair of printing couples C each of which comprise an inker unit 1 and dampener unit 200. If it is necessary to print two colors on one side of web W, then the right hand couple C as viewed in FIG. 5 must be reversed such that the web W may be routed for printing on a single side. In reversing the direction of the form roller 90, dampening fluid will be applied over the thin ghosted film of ink leaving the plate 112 after ink storage roller **94*b* evens the ink film to some extent. A fresh supply of ink will be added to the dampening fluid and ink on form roller 90 as the roller 90 moves through nip A. Thus, the couple C may be reversed by simply reversing the drive to the couple and motors 69 and 269**.

It should be readily apparent that the films of ink and dampening fluid illustrated in FIG. 1 represent a standard printing couple moving in the normal or standard direction and that their films would change in location from those illustrated should the couple be reversed to apply dampening fluid first and ink on the dampening fluid.

Figures 7, 9:
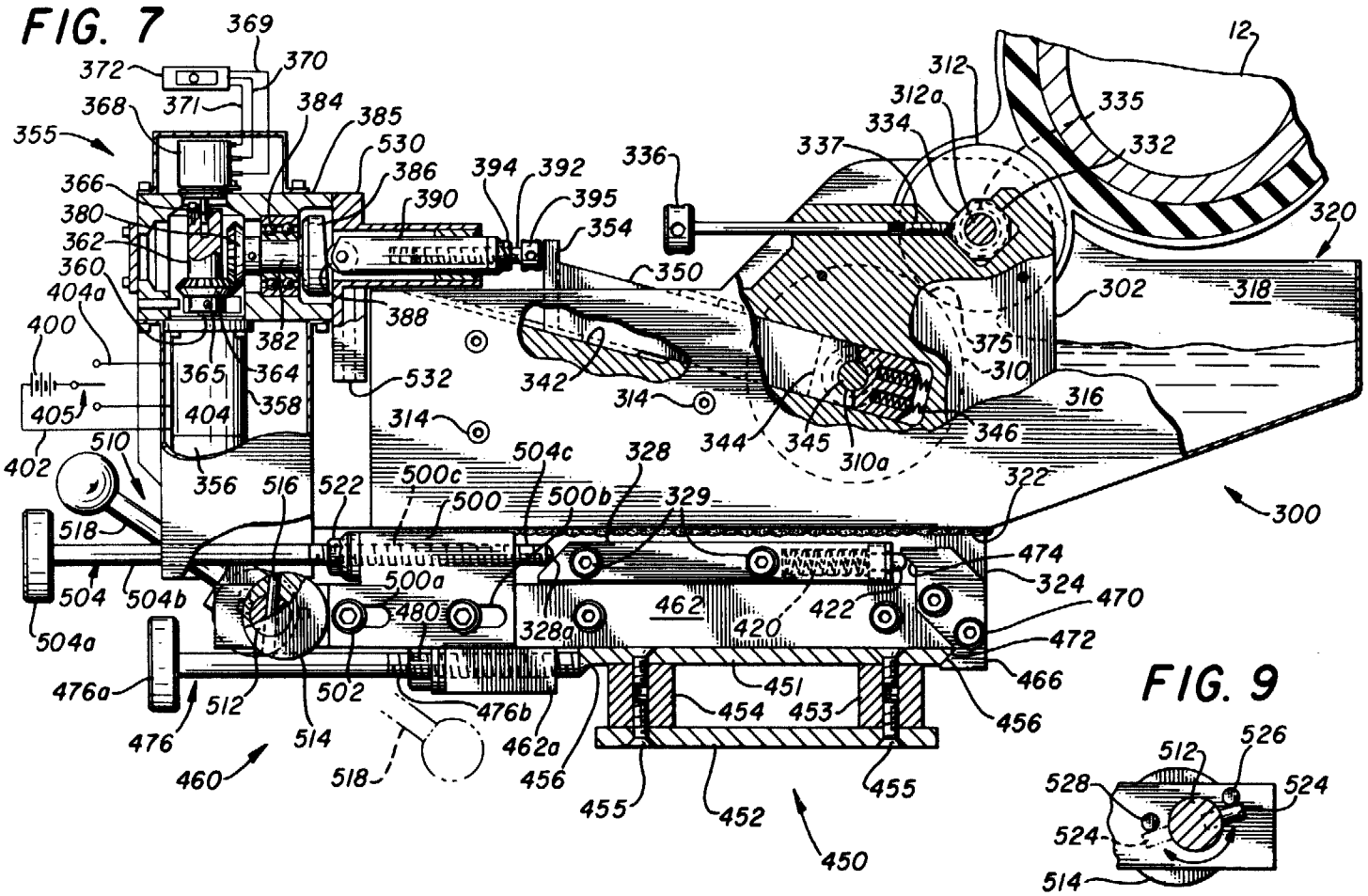
FIG. 7 is a cross-sectional view taken along line 7—7 of FIG. 2.
FIG. 9 is a cross-sectional view taken along line 9—9 of FIG. 8.

Referring to FIG. 7 of the drawing, the portable ink fountain 300 comprises spaced support plates 302 and 304 for rotatably supporting a pick-up roller 310 and an applicator roller 312. Support plates 302 and 304 are secured by screws 314 to the end walls 316 and 318, respectively, of pan 320.

The bottom 322 of pan 320 is welded to spaced support bars 324 and 326. Locking bars 328 and 330 are secured by screws 329 to support bars 324 and 326, respectively.

As will be hereinafter more fully explained, locking bars 328 and 330 are detachably secured by suitable support means to the printing press.

If the plate cylinder on the printing press has four printing plates mounted across the length thereof four portable fountains 300 would be mounted side by side for applying ink to metering roller 12.

Figure 8:
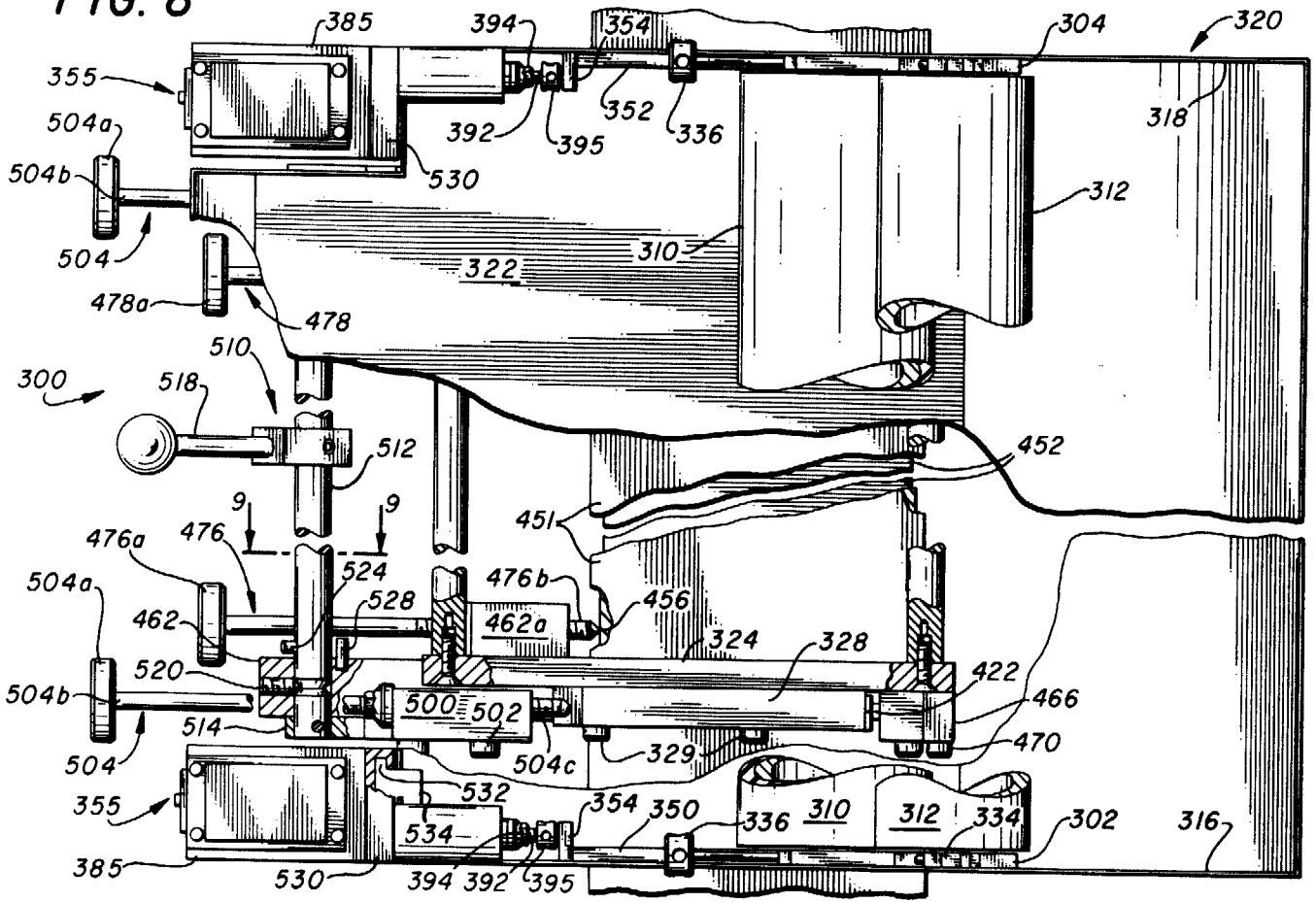
FIG. 8 is a top plan view with parts broken away of a portable ink fountain constructed according to the present invention.

Referring to FIGS. 7 and 8 of the drawing, pick-up roller 310 preferably has a smooth resilient surface urged into pressure indented relation with the surface of applicator roller 312 which has a hard textured surface. In the particular embodiment illustrated, applicator roller 312 has a knurled surface so that the surface is somewhat roughened to provide frictional driving force for rotation of applicator roller 312 and pick-up roller 310 when the surface of applicator roller 312 is urged into pressure indented relation with metering roller 12 of the inking system.

Support plates 302 and 304 have slots 332 formed therein in which bearing blocks 334 are mounted. Each bearing block 334 supports a bearing 335 which in turn supports an axle **312*a* or 312*b* extending outwardly from opposite ends of applicator roller 312. Bearing block 334 is secured in position by a locking screw 336 which extends through a threaded passage 337 in support plates 302 and 304**.

Axles **310*a* and 310*b* extend outwardly from opposite ends of pick-up roller 310 into bearings 345 supported by bearing blocks 344 which are slidably mounted in slots 342 formed in support plates 302 and 304. Springs 346 engage the bottom of slot 342 and urge bearing blocks 344 toward a position which would separate surfaces of rollers 310 and 312**.

Hangers 350 and 352 are secured to bearing blocks 344 and are slidably secured to side plates 302 and 304. Each hanger 350 and 352 is provided for adjusting the position of bearing block 344 relative to support plates 302 and 304 for adjusting pressure between adjacent surfaces of rollers 310 and 312.

The adjustment means 355 comprises an electric motor 356 for driving a gear reducer 358 having an output shaft 360. A drive adapter 362 and a gear 364 are secured by a pin 365 to shaft 360. The lower end of adapter 362 extends through a central opening in gear 364 such that adapter 362 and gear 364 rotate with shaft 360.

The upper end of adapter 362 is secured to the shaft 366 of a position potentiometer 368 which has outlet conductors 369, 370 and 371 which are electrically connected to a read-out device 372 adapted to indicate the relative pressure or the relative stripe width at the nip 375 between pick-up roller 310 and applicator roller 312 as will be hereinafter more fully explained.

Gear 364 is positioned in a meshing relation with gear 380 which is secured to a shaft 382 supported in bearings 384 mounted in an opening in housing 385.

A cam plate 386 is secured to the end of shaft 382 and is engaged by a follower 388 on rotatively secure bar 390. An adjusting screw 392 is provided on shaft 382 for adjusting the distance between the end of follower 388 and the end of the head 395 on adjusting screw 392 and a lock nut 394 is provided on shaft 382 to prevent unintentional rotation. The head 395 of adjusting screws 392 engages hanger lug 354 on hanger 350.

When motor 356 is energized shaft 360 will rotate thereby imparting motion through gears 364 and 380 to the shaft 382. When shaft 382 is rotated cam 386 will rotate thereby moving follower 388 and head 395 on adjusting screw 392 for imparting longitudinal motion to hanger 350. Movement of hanger 350 causes bearing block 344 and pick-up roller 310 to be moved relative to applicator roller 312 for adjustment of the width of the stripe at nip 375. Position indicator 372 is calibrated with adjusting screw 392 such that when the surfaces of rollers 310 and 312 are in kiss contact position indicator 372 will provide a suitable read-out to so indicate. When motor 356 is rotated for increasing the width of the stripe at nip 375 position indicator 372 would indicate the pressure or the width of the stripe at nip 375.

Motor 356 is preferably driven by a suitable source of electricity 400 through conductors 402 and 404 when switch 405 is closed. Motor 356 will be de-energized when switch 405 is open and reversed when switched to contact conductor **404*a***.

Switch 405 is preferably located adjacent the side frame of the printing tower or at a console of the press so that the adjustment of pressure at nip 375 can be remotely controlled.

It will be appreciated that a pressure adjustment means 355 is located adjacent each of the support plates 302 and 304 of each of the portable fountains 300 such that the stripe at nip 375 is independently adjustable at each end of pick-up roller 310. Further, means may be employed such as a threaded screw device to impart motion to hanger lug 354 for adjustment of nip 375 which would not necessarily be a remotely controlled mechanism.

Locking bars 328 and 330 have beveled ends 328*a* and 330*a* that tapers downwardly and faces the end of container 320 wherein remotely controlled means 355 are supported. The opposite end of each locking bar 328 and 330 has recess provided therein which receives a spring 420 which acts against locking bars 328 and 330 to urge each pin 422 in a direction away from the respective beveled shoulder 328*a* or 330*a*.

Support structure 450 is mounted between side frames 2 and 4 by support brackets 450*a* for supporting portable ink fountains used with a printing press. Support structure 450 comprises a main support plate 451, a back-up support plate 452 which extends substantially parallel to main plate 451, and spacer bears 453 and 454 extending between and along the length of support members 451 and 452 and being connected thereto by use of screws 455. Inwardly beveled shoulders 456 are disposed on either side of main support plate 451 for receiving a clamping apparatus 460 connectable to each portable ink fountain.

Clamping mechanism 460 is constructed to permit movement of each fountain 300 along support structure 450 to permit adjustable positioning of pan 320 relative to the printing cylinder and includes a frame having spaced side walls 462 and 464 extending generally parallel to and closely adjacent with locking bars 328 and 330. A locking bracket 466 is connected to and exteriorally of each side wall 462 and 464 by screws 470. Brackets 466 include clamping shoulders 472 and 474 forming complimentary locking angles for support plate 451 and pins 422, respectively. Side walls 462 and 464 have threaded passageways 462*a* and 464*a* extending longitudinally of the length of side walls 462 and 464. Locking screws 476 and 478 have heads 476*a* and 478*a* provided on an end and male threads 476*b* and 478*b* on the other end which matingly engage with threaded passageways 462*a* and 464*a*. Screw members 476 and 478 terminate in conical shaped shoulders at the threaded end for engaging with the beveled shoulders 456 on support member 451. Thus, by the heads 476*a* and 478*a* of screw member 476 and 478, side members 462 and 464 are attached to support member 450 by gripping support member 451 at beveled shoulders 456 to thereby form a C clamp type attachment. Once attached, locking nut 480 provided on each screw member 476 and 478 is rotated against a shoulder of each side member 462 and 464 to thereby maintain locking action.

A sliding block 500 is slidably attached to each side wall 462 and 464 by use of bolts 502 extending through slots 500*a* and 500*b*. A threaded passageway 500*c* extends substantially parallel to slots 500*a* and 500*b* and is generally aligned with the locking bar 328 or 330.

An adjusting screw member 504 having a head 504*a* from which a shaft 504*b* extends into a male threaded portion 504*c* for matingly engaging threaded passageway 500*c*. Thus, by rotating head 504*a*, shaft 504*b* moves longitudinally through passageway 500*c* with the outboard end engaging beveled shoulder 328*a* and 330*a* to urge locking bars 328 and 330 toward locking bracket 466. Thus, by adjusting screw member 504, container 320 and applicator roller 312 is moved in the direction of and in indented relationship with metering roller 12 while securing pan 320 to clamp member 460.

To facilitate removal of the pan for clean up operations without the requirement of re-adjusting screw member 504, apparatus 510 is provided to permit quick withdrawal of fountain 300. This apparatus 510 includes a shaft 512 rotatably disposed in side bars 462 and 464. An eccentric cam 514 is connected to each end of shaft 512 by a pin 516 and engages on its periphery a facing shoulder on slide block 500. Disposed intermediate of each cam 514 is a handle 518 for rotating eccentric cams 514 about the axis of rotation of shaft 512. By such movement, slide bar 500 and screw 504 are moved in a direction permitting disengagement of the end of threaded member 504 from beveled shoulders 328*a* and 330*a*, thus allowing removal of pan 320 from clamping mechanism 460.

As shown in solid outline in FIG. 7, the radial distance of cam surface 514 is such that counter-clockwise movement will cause eccentric cam 514 to move sliding block member 500 slightly toward metering roller 12 and continued counter-clockwise movement, to the dotted outline as shown in FIG. 7, will cause pan 320 to become disengaged from connecting member 460 by permitting movement of block 500 which carries thread member 504 away from bracket 466.

As shown in FIG. 8, a set screw 520 is provided in members 462 and 464 to lock handle 518 in position and thereby prevent rotational movement and unlocking of pan 320 from 460. If desired however, this set screw may be replaced with a locking detent arrangement to accomplish the same result.

A locking tension nut 522 is threadedly connected to threaded portion 504*c* of adjusting member 504 to lock member 504 in position when adjustment has been obtained.

Further, a stop member 524 may be mounted on shaft 512 to co-act with stops 526 and 528 provided on bracket 462 and 464 to limit rotation of handle 518 of quick removal member 510. As shown in solid and dotted outline in FIGS. 7 and 9.

Remotely controlled means 355 may be removably mounted to pan 320 by use of a bracket 530 having a T-slot 532 provided therein mounted with housing 385 supporting adjustment means 355. A T-shaped bracket 534 is attached to the end of pan 320 for matching engagement in T-slot 532 for slidable engagement therein in a direction perpendicular to the direction that forces are generated in nip 375 when moving pick-up roller 310 into pressure engagement with applicator roller 312.

Figure 10:
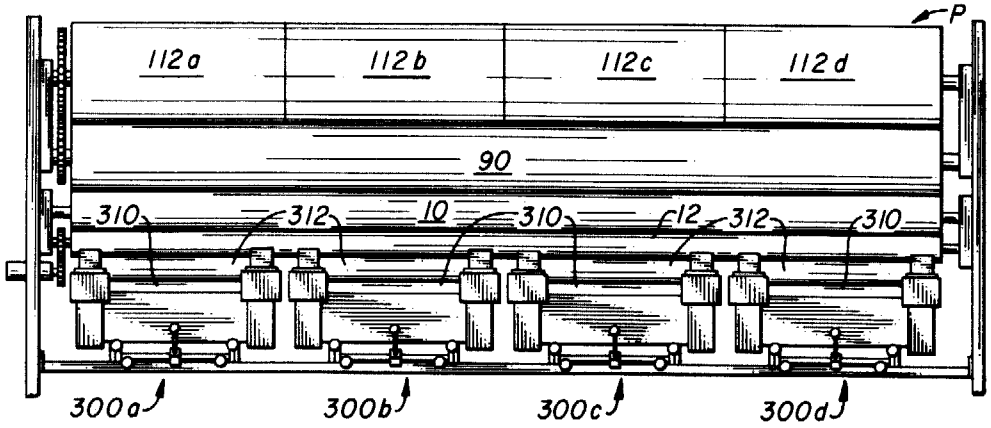
FIG. 10 is a diagrammatic illustration of the inking system for a lithographic printing press illustrating the use and positioning of single page portable ink fountains constructed according to the present invention.

As shown in FIG. 10, a plurality of single page ink fountains may be disposed across the width of a printing press for each page on the printing cylinder such cylinders 112*a*, 112*b*, 112*c* and 112*d* having ink fountains 300*a*, 300*b*, 300*c* and 300*d*. In this configuration, if one cylinder, say cylinder 112*c*, is not being used, then the handle 518 of fountain 300*c* may be rotated downward, as shown, to remove the ink supplied to cylinder 112*c*. Further, if only the right portion of one cylinder 112*c* has a plate and the cylinder 112*d* is not being used, then fountain 300*d* is removed and fountain 300*c* moved to the right to provide ink to the right hand side of cylinder 112*c*.

Figure 11:
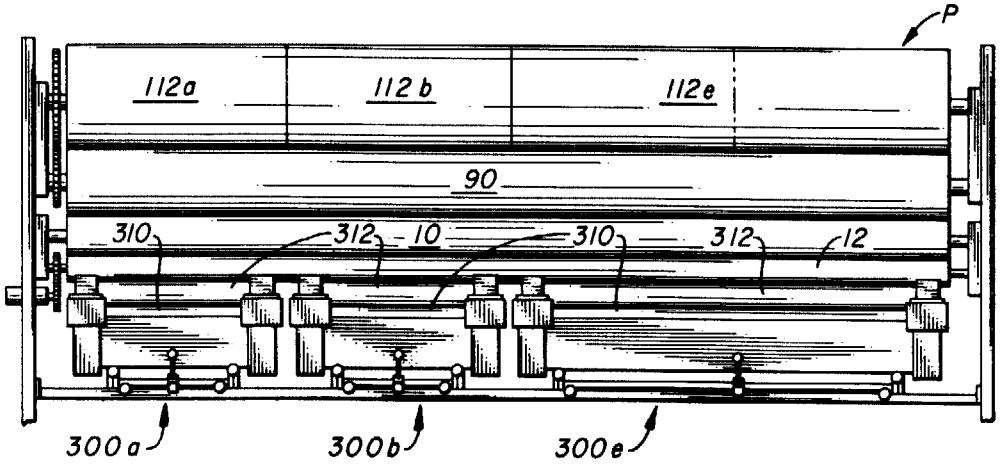
FIG. 11 is a diagrammatic illustration of the inking system for a lithographic printing press illustrating the use and positioning of single page and double truck portable ink fountains constructed according to the present invention.

As shown in FIG. 11, ink fountains constructed according to the present invention may be single page size 300*a* and 300*b* or of double truck size 300*c* for supplying ink to a printing press cylinder of single page size 112*a* and 112*b* or to double truck size 112*e*.

Having described our invention we claim:

1. A method of metering ink which is to be applied by a roller apparatus to a printing plate wherein the roller apparatus is rotated such that its surface speed is substantially equal to the surface speed of the printing plate, the improvement comprising: positioning a metering roller, which is positively driven by a variable speed drive, in pressure indented relation with the roller apparatus to form an ink metering nip; supplying ink from first and second rollers to the ink metering nip; rotating said first and second rollers by frictional force from said metering roller such that adjacent surfaces move in the same direction to form a film of ink on the metering roller; positioning the metering roller in pressure indented relation with the roller apparatus; and rotating the ink metering roller such that the surface speed thereof is less than the surface speed of the roller apparatus, said roller apparatus including at least one transfer roller which is frictionally driven at a surface speed which is greater than the surface speed of the metering roller.

2. An inker for lithographic printing press wherein ink is applied by a resilient surfaced form roller to a plurality of spaced printing plates secured to a plate cylinder, the improvement comprising: positive drive means for rotating the form roller; a transfer roller having a hard surface urged into pressure indented relation with the resilient surface on the form roller, said transfer roller being frictionally driven by said form roller; a metering roller having a resilient surface; variable speed drive means drivingly connected to said metering roller to drive said metering roller at a surface speed less than the surface speed of the form roller; an applicator roller having a hard textured surface; a pickup roller having a resilient surface; a pan to hold a quantity of ink; and means connectable to said pan for adjustable positioning said pan to a frame of a printing press such that said pickup roller and said applicator roller are urged into pressure indented relation and said applicator roller is urged into pressure indented relation with said metering roller, said applicator roller being frictionally driven by said metering roller and said pickup roller being frictionally driven by said applicator roller.

3. An inker according to claim 2 with the addition of a plurality of applicator rollers, pickup rollers and ink pans, each applicator roller being positioned to apply ink to spaced segments along the length of said metering roller to permit application of different ink films to different segments of the surface of said metering roller.

4. An inker according to claim 3 wherein the textured surface on the applicator roller comprises a knurled surface.

* * * * *